United States Patent [19]

Kaiser

[11] Patent Number: 4,741,418

[45] Date of Patent: May 3, 1988

[54] ELECTROMAGNETIC ENERGIZATION SYSTEM WITH NON-COILED, SINGLE WIRE CONDUCTOR

[76] Inventor: Helmut Kaiser, Wohrwiese 4, D-8540 Schwabach, Fed. Rep. of Germany

[21] Appl. No.: 664,848

[22] Filed: Oct. 25, 1984

[51] Int. Cl.[4] ..... B60L 9/16

[52] U.S. Cl. ..... 191/10; 104/292; 446/465; 310/12

[58] Field of Search ..... 104/288, 295, 296, 290, 104/292; 105/49, 53; 191/10; 310/12, 13, 156; 446/465, 484

[56] References Cited

U.S. PATENT DOCUMENTS

| | | | |
|---|---|---|---|
| 776,826 | 12/1904 | Caldwell | 310/13 |
| 2,187,085 | 1/1940 | Kisling | 191/45 |
| 2,638,347 | 5/1953 | Maggi | 273/86 |
| 3,111,265 | 11/1963 | Huber | 238/148 |
| 3,206,891 | 9/1965 | Adamski | 46/235 |
| 3,390,290 | 6/1968 | Kaplan | 310/156 |
| 3,403,272 | 9/1968 | Dold | 310/12 |
| 4,091,995 | 5/1978 | Barlow et al. | 238/10 A |
| 4,404,484 | 9/1983 | Gillott | 310/156 X |
| 4,459,438 | 7/1984 | Kaiser | 191/10 |

FOREIGN PATENT DOCUMENTS

| | | | |
|---|---|---|---|
| 857019 | 11/1952 | Fed. Rep. of Germany . | |
| 941659 | 4/1956 | Fed. Rep. of Germany . | |
| 1067351 | 10/1959 | Fed. Rep. of Germany . | |
| 1079516 | 4/1960 | Fed. Rep. of Germany . | |
| 2055187 | 5/1972 | Fed. Rep. of Germany . | |
| 2364331 | 6/1975 | Fed. Rep. of Germany | 104/290 |
| 2932630 | 2/1981 | Fed. Rep. of Germany . | |
| 1353598 | 1/1964 | France . | |
| 746025 | 3/1956 | United Kingdom . | |
| 979985 | 1/1965 | United Kingdom . | |
| 1143801 | 2/1969 | United Kingdom | 310/13 |
| 493868 | 2/1976 | U.S.S.R. | 310/12 |

*Primary Examiner*—Robert B. Reeves
*Assistant Examiner*—Scott H. Werny
*Attorney, Agent, or Firm*—Bacon & Thomas

[57] ABSTRACT

An electromagnetic energization system is disclosed wherein a stray alternating magnetic field is generated by conducting a current through a discrete (i.e., indefinite) length of wire or rod instead of a fine wire winding. A permanent magnet rotor is disposed so that it intersects the stray field in an appropriate manner to effect rotation of the rotor, which rotation is usable to energize or propel an object located in the vicinity of the conductor. The conductor, usable with toy vehicles and multiple track segments, is of single continuous length or is series connectable by means of quick disconnect electrical connectors. The permanent magnet rotor can be incorporated in a planetary gear system to achieve speed reduction between the spinning rotor and a drive mechanism for a mobile object. The orientation and effect of the magnetic field is controllable by varying the polarity of the current passing through the conductors, the frequency of the alternating current used to generate the field, and the current.

9 Claims, 2 Drawing Sheets

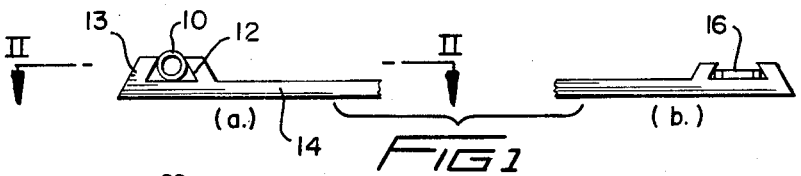
FIG 1
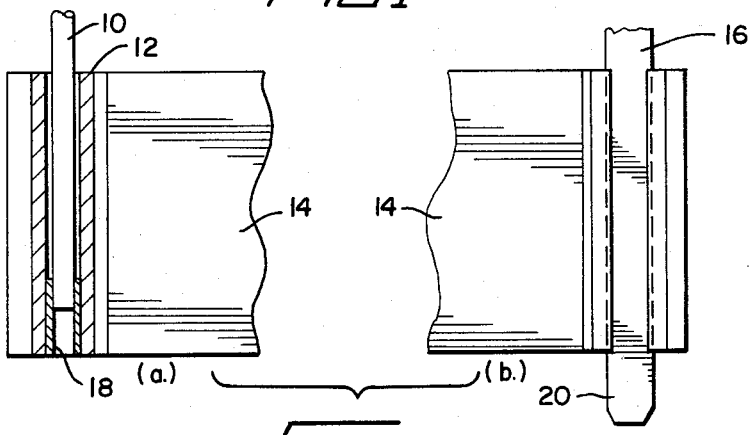
FIG 2
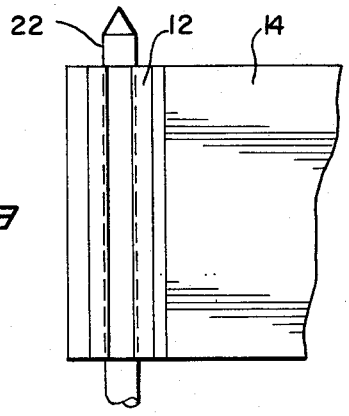
FIG 3
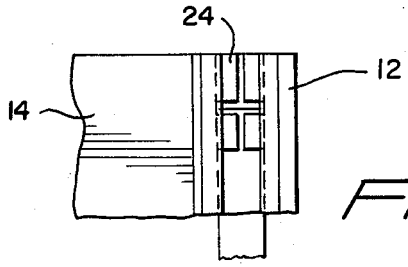
FIG 4A
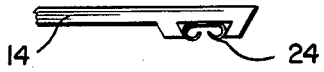
FIG 4B
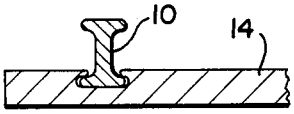
FIG 5
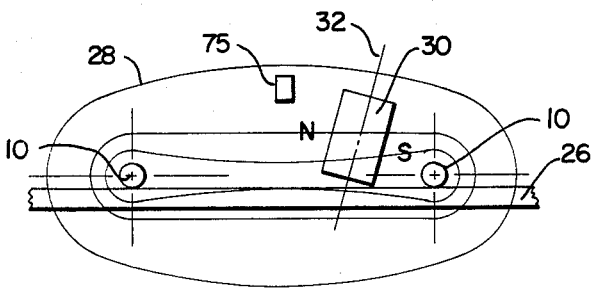
FIG 6
FIG 7
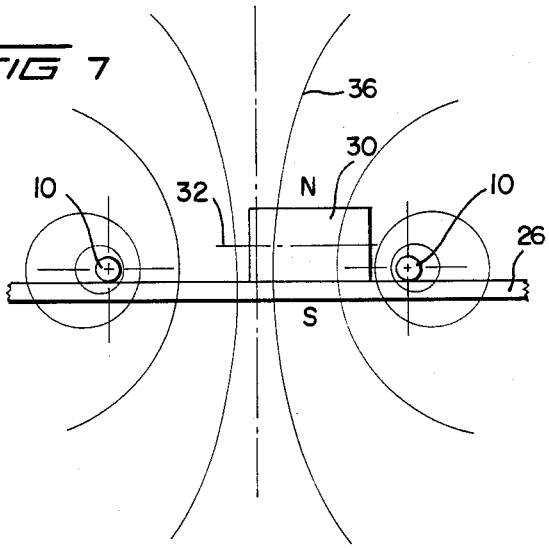

ELECTROMAGNETIC ENERGIZATION SYSTEM WITH NON-COILED, SINGLE WIRE CONDUCTOR

BACKGROUND OF THE INVENTION

1. Field of the Invention

This invention concerns an electromagnetic energization system involving the generation of a stray alternating magnetic field by, preferably, discrete lengths of conductors carrying alternating current, whereby the resulting alternating magnetic field is utilized to cause synchronous rotation of a permanent magnet rotor placed within the field. The rotation of the rotor can be used to energize a mobile object, such as a miniature toy vehicle, placed in close proximity to the conductor.

2. Description of Prior Art

Stray field magnetic energization systems are known, and in particular systems for powering and controlling small mobile objects. The use of an alternating magnetic field is generally known and such systems utilize the field to cause synchronous of a permanent magnet rotor, which rotation is used to propel the mobile object. Such systems are usually associated with a fixed track or roadway for supporting the mobile object and furthermore utilize electrical coil "windings" comprising multiple coiled strands of fine wire which, when an alternating voltage is applied thereto, induce an alternating magnetic field in the vicinity of the windings. The use of such windings is conventional and frequency control systems are routinely used to vary the frequency of the alternating field induced by the winding. An illustrative example of such a prior art system can be seen in U.S. Pat. No. 4,459,438 of the present applicant.

In alternating field energization systems of the type described above, several considerations must be taken into account. The rotary speed of the permanent magnet rotor, if synchronous with the alternating field frequency, quite likely will be too high to be used in a direct drive system, when the rotor (or another element connected to the rotor) directly engages a track or other support surface via a wheel or roller to impel the vehicle. Thus, reduction gearing of some kind is usually required. The usual arrangement is simple spur gearing or the like to achieve the speed reduction.

Another consideration respecting prior art magnetic energization systems is the cost and physical size of the various components used in the systems, particularly the wire windings and the track elements, which may be multiple segments with electrical connectors providing circuit continuity between the segments. Many of the prior art systems require bulky and costly coil windings involving many lengths of fine wire mounted in each track element, for example by molding same in the track material, to generate the stray field. The losses from such windings can be considerable, and other disadvantages are readily apparent. The physical track layout is usually limited by the winding configuration and the tracks are not readily utilizable by multiple mobile objects that can be separately and independently controlled in a suitable inexpensive manner.

The present invention overcomes the disadvantages of the prior art and results in a simple, low cost magnetic energization system for miniature mobile objects, such as small toy vehicles.

BRIEF SUMMARY OF THE INVENTION

This invention proposes the use of discrete (i.e., indefinite) lengths of relatively heavy gauge wire or rods as alternating current conductors for creating stray magnetic fields that can induce synchronous rotary motion in a special magnet rotor that is placed adjacent the conductor. The conductors are arranged to extend over desired continuous paths of movement of the mobile object with which they cooperate. Fine wire coil windings are not required, the construction is simplified, and the cost of producing the system is drastically reduced. The connectors between the conductors are simplified by simply using conventional plug and socket quick disconnect connectors for electrically joining the wires or rods together. The heavy gauge wire or rod can be snapped into a mating groove or slot in or on a track or other surface, or extend over an entire course where the magnetic stray field is desired. Also the discrete lengths of conductor can be placed on or beneath a surface or in water, even, if it is desired to energize an object on such surface or in the water.

A magnet rotor that may be used with the system is shaped like a shaft or disc (i.e., a short shaft) with the poles thereof disposed diametrically opposite from each other on either side of the axis of rotation of the magnet. The magnet is intended furthermore to be carried by a mobile object, such as a toy vehicle. A confined track is not required, since only the presence of a conductor and the alternating current is needed to induce a suitable stray magnetic field near which can be placed the mobile object with the magnetic rotor therein properly oriented with respect to a stray field.

Multiple conductors can be provided for generating reinforced or opposed fields within a same area that is desired to be established as a path of movement of a mobile object containing the magnet rotor. Several independently controllable vehicles can be energized by fields generated through the use of independently controllable multiple conductors extending along the same pathway of travel of the mobile objects. The conductors can even be stacked vertically to achieve special effects. By orienting the magnet rotors within the mobile objects in various attitudes, various effects and speeds can be achieved. In addition, the magnets can be used as an auxiliary power supply within a vehicle or other mobile object that is propelled by energization of a separate magnet.

A significant advantage of the invention is the utilization of the low self-inductance of the conductors. Direct current can be used in the wires to generate non-alternating fields for special control or other effects.

Other objects and advantages of the invention shall be evident from the following detailed description, considered with the attached drawings.

DESCRIPTION OF THE DRAWINGS

FIGS. 1*a* and 1*b* show two typical embodiments of a track or roadway for supporting a mobile object incorporating the discrete length conductors arranged in accordance with this invention;

FIGS. 2*a* and 2*b* are views taken along line II—II of FIGS. 1*a* and 1*b*, respectively;

FIGS. 3 and 4*a* show mating section of the track or roadway that are connectable with the sections shown in FIGS. 2*a* and 2*b*, respectively;

FIG. 4*b* shows an end view of the track section shown in FIG. 4*a;*

FIG. 5 shows an alternative embodiment of the invention shown in FIGS. 1*a* and 1*b;*

FIG. 6 shows the magnetic field generated by a pair of conductors carrying alternating currents of the same polarity and the relationship of such a field with a permanent magnet rotor placed within the resultant horizontal field between the conductors;

FIG. 7 shows the magnetic field generated by a pair of conductors carrying alternating currents in opposite directions and the relationship of such field with a permanent magnet rotor disposed between the resultant vertical field set up between the conductors;

DETAILED DESCRIPTION OF THE INVENTION

Figure 8:
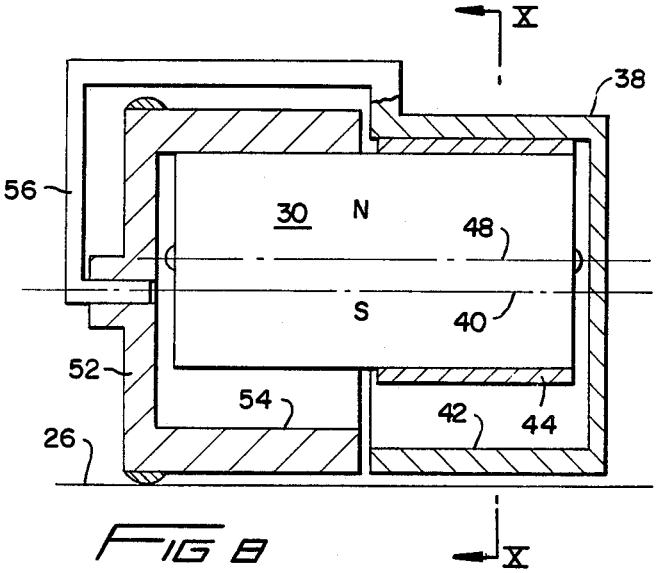
FIG. 8 shows one embodiment of a planetary-type speed reducer wherein the permanent magnet rotor is one of the rotatable elements of the speed reducer.

With reference to the attached drawings, FIGS. 1*a* and 1*b* show illustrative examples of the use of discrete lengths of conductors in conjunction with a mobile object support medium, such as a planar roadway or track surface. In FIG. 1a, a round conductor rod 10 is disposed, e.g., by a snap-fit connection, within a channel 12 within projection 13 that is disposed on track or roadway section 14 that functions as a medium for guiding and supporting an object, such as a toy or toy vehicle, energizable by a spinning permanent magnet rotor within the object.

Alternatively, the conductor 10 itself could serve as a rail for engaging and guiding a toy rail vehicle with the rail mounted in a snap-in channel in support 14 (see FIG. 5).

Another alternate embodiment of the conductor is shown at 16 in FIG. 1*b*, whereat the conductor 16 is illustrated as a flat rod-like element or a strip-like conductor. The conductor 16, like the conductor 10, can be disposed within a suitable channel corresponding to channel 12, but shaped to receive the flat conductor 16 with a minimum of excess channel defining material. FIGS. 2*a* and 2*b* show the FIG. 1*a* and 1*b* embodiments in plan view, like reference numerals being used for the same elements.

In practice, alternating current from independent circuits would be applied to the conductors 10 and 16 to generate a stray magnetic field around the conductor in accordance with well-known principles of physics. That is, when a conductor is energized with a direct (DC) current, the flow of electricity through the conductor induces a stray field around the conductor in accordance with the "right hand rule". The stray field is an electromagnetic field in which the field potential is in the direction of the fingers of an imaginary right hand if the hand were placed around the conductor with the thumb poiting in the direction of electrical current flow through the conductor. A magnet placed in the vicinity of the field would try to move so that its poles "lined up" with the field. If the current in the conductor was then alternated, the magnet would synchronously oscillate with the field as it tended to follow the constantly reversing field polarity. By tuning the magnet mass to the field strength and current frequency, the magnet can be made to completely rotate in synchronism with the alternating field by causing the momentum of the magnet to carry it past the "aligned" point each cycle so that it rotates 360° instead of oscillating 180° each cycle. The only essential requirement, besides the tuning of the magnet mass and current frequency, is that the magnet be oriented so that at least a component of the magnetic field intersects the magnet transversely across its axis of rotation so that the magnet will be induced to line up its poles with the field. A permanent magnet rotor disposed so that it intersects the field with its rotary axis appropriately oriented will be caused to spin synchronously at a frequency corresponding to the alternating current impressed on the conductors. A further discussion of the principle of operation will be presented below.

With reference to FIGS. 2*a* and 2*b*, the conductors 10 and 16 are provided with suitable quick-disconnect male and female couplings 18, 20 which can be provided on the ends of separable sections of track or roadway elements 14. FIGS. 3 and 4*a* illustrate corresponding female and male quick-disconnect couplings (for example, simple sliding plug and socket connections) 22, 24 intended to mate with connectors 18, 20. FIG. 4*b* illustrates an end view of the track section shown in FIG. 4*a*, and illustrates how a typical socket connection would appear when viewed from the end of the track section. The track sections also can be simply mechanically coupled together and the conductors snapped into place over several or all the track lengths.

It should be understood that only a single conductor 10 is required to provide an energizing field for a permanent magnet rotor adjacent the conductor. The conductor 10 is intended to carry all of the energizing current that generates the stray magnetic field and is not simply a single conductor in a multiple, thin wire coil winding that is typically utilized in magnetic energization systems constructed in accordance with the prior art. While the conductor 10 may be configured in the form of an annular loop, this is to be distinguished from the typical "multiple loops of fine wire windings" typical of the prior art for inducing a magnetic field, since the loop of this invention is a conductor of the alternating current and is a length of heavy wire or rod, not a winding. The conductor, moreover, extends in continuous fashion over the desired path of travel of a mobile object with which it cooperates, not in a loop constituting only part of the path of movement of the mobile object.

With reference to FIG. 6, a pair of conductors 10 extending along a support medium such as a surface 26, which incidentally could be a solid or liquid surface, such as water, is utilized to generate a stray magnetic field illustrated by flux lines 28. In this example, alternating voltages of identical polarity and frequency would be impressed on conductors 10 to create stray magnetic flux fields 28 that cooperate to create strong horizontal components between the conductors 10. Accordingly, if a permanent magnet rotor 30 is placed between the conductors with its axis of rotation 32 disposed to be intersected by the fields 28 as shown, rotation of the magnet rotor will be effected in synchronism with the alternating current in accordance with well-known magnetic principles. Moreover, the magnet rotor 30 could be disposed virtually anywhere between the conductors and will be influenced by the fields 28 in a rotational sense about the axis of rotation 32. Such rotational energy, of course, is contemplated to be utilized to motivate or power a mobile object carrying the magnet in a manner permitting its traversal along the surface 26. For example, a miniature toy vehicle (not shown) would carry a tiny magnet rotor similar to the magnet rotor 30, the rotational energy of which could be utilized to directly drive a wheel or to indirectly drive a propelling element through reduction gearing. The conductors 10 could also form tracks or be embedded in one or two tracks for energizing railway vehicles supported by the tracke. A non-mobile object or toy also could be energized by the rotating magnet to animate same or cause some parts thereof to move, as long as the object was located adjacent the flux field 28.

With reference to FIG. 7, the conductors 10 are shown carrying alternating current of opposite polarity, which results in the generation of fields that cooperate to form strong, vertical components between the conductors 10, the vertical components of the flux being represented by lines 36. It will be observed that a magnet rotor 30 placed between the conductors 10 with the rotation axis 32 of the rotor intersecting the flux lines 36 will be caused to rotate in the same manner as illustrated in FIG. 6. This arrangement permits the magnet rotor 30 to be oriented in a manner whereby the rotation of the magnet can be utilized to directly energize an object by functioning, for example, as a driving wheel along a direction of travel extending near the conductors 10 and generally parallel thereto. If line 26 represents a surface against which the rotating surface of magnet 30 can apply a propelling force, it will be evident how the spinning magnet 30 can be utilized to energize a mobile object carrying the magnet rotor by directly engaging the surface.

Figure 10:
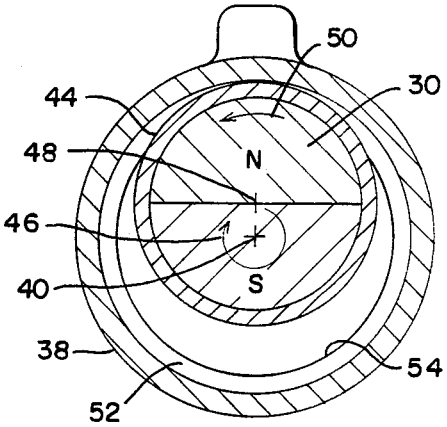
FIG. 10 is a view taken along line VIII—VIII of FIG. 8.

With reference to FIGS. 8 and 10, it is desirable to provide a speed reducer for the rotary magnet 30 whereby the magnet 30 is utilized as part of a planetary gear train. As an illustrative example, a magnet rotor 30 in FIG. 8 can be supported within fixed housing 38 which, for example, may comprise a part of the mobile object. The magnet 30 is supported so that it can spin around the interior of a cylindrical raceway 42 about axis 40. A suitable friction coating 44 enables the peripheral area of one end of the magnet 30 to be drivingly coupled to the interior of the raceway 42. Upon energization of the magnet by the alternating magnetic field, the magnet 30 will spin around inside the raceway 42 about axis 40. In effect, the magnet 30 actually orbits about axis 40 in one direction as indicated by arrow 46 in FIG. 8 while it spins about its own axis of symmetry 48 in the opposite direction as indicated by arrow 50.

The orbital motion of the rotary magnet is transmitted to a support surface or medium 26 via a drive wheel 52 within which is provided a second raceway 54 which also receives the other end of the magnet which slides around within the interior of the raceway 54 in slipping relationship. Since the diameter of the raceway 54 is smaller than the raceway 42, the orbiting motion of the magnet 30 will cause the drive wheel 52 to be driven in a rotary direction about axis 40. A suitable mounting means 56 is provided, of course, to retain the wheel 52 in its proper relationship with the other structure. Thus, in effect, the system is seen to comprise a planetary speed reducer for coupling the magnet rotor to the wheel, with the magnet rotor constituting a movable part of the planetary speed reducer. The housing 38 and the wheel 52 protect and contain the magnet rotor 30. With the arrangement shown, reduction ratios on the order of 1:100 can be obtained, which is a substantial advantage, considering the frequencies of the alternating current expected in the energization system of the present invention.

Figure 9:
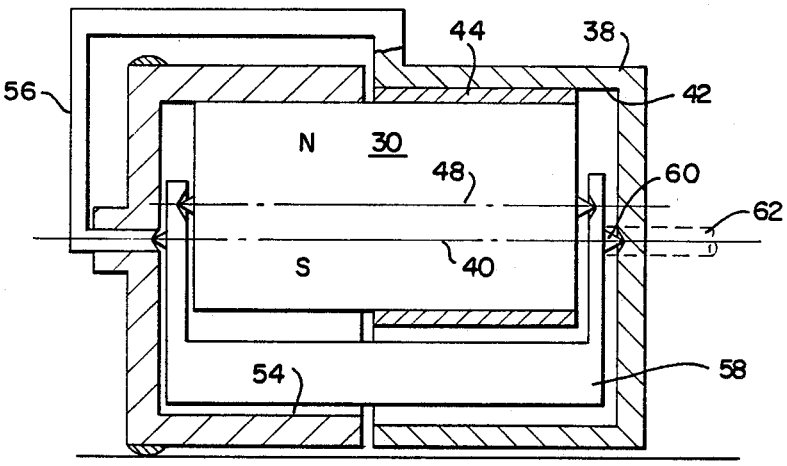
FIG. 9 shows another embodiment of a planetary-type speed reducer similar to FIG. 8.

In FIG. 9, an alternate embodiment of the planetary speed reducer shown in FIG. 8 is illustrated. Here, the magnet rotor 30 is provided with a spinning counterweight 58 mounted for rotational movement about orbit axis 40 by means of spindle supports 60. The counterweight 58 counterbalances the eccentric loading imposed on the housing 38 by the magnet rotor 30 as it orbits about axis 40.

It will be clear in both of the embodiments of FIGS. 8 and 9 that the friction coating 44 could be replaced by meshed gear teeth and that a power takeoff for reduction gears could be provided through, for example, a shaft such as shown in hidden lines 62. As a further alternative, a rotating magnet could be utilized to turn shaft 62 from the right and the element 30 could constitute a simple planetary gear element.

Figure 11:
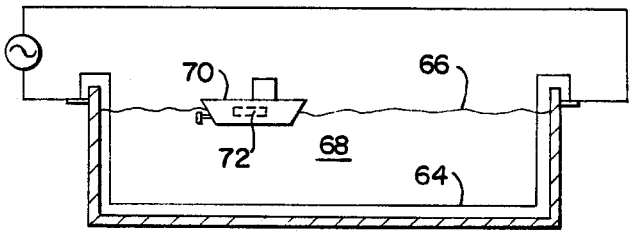
FIG. 11 shows the invention used to propel a toy boat.

In FIG. 11, a single conductor 64 is illustrated beneath the surface 66 of a body of water 68 in which is floated a toy boat 70 energized by a permanent magnet 72. A similar conductor could, if desired, be buried in the ground to energize a magnet located above or on the surface of the ground.

Accordingly, the use of lengths of conductors extending continuously along the path of travel of the permanent magnet and its associated mobile object without the need for coil windings in the magnetic energization system constructed in accordance with the present invention provides economic advantages and other benefits. A single conductor or separate conductors can carry different frequencies or different polarity currents to permit mulitple magnet rotors to be energized. The supplemetal use of direct current increases the number of possibilities for controlling the mobile objects adjacent the conductors. Aluminum wires, for example, having a diameter of approximately 2 mm and nickelplated can be used with integral plug and socket connectors at their opposite ends for connecting segments of tracks. Also, a heavy gauge wire, insulated or bare, can be snapped into a receiving channel in the track sections. A closed track is not required, merely a field. If existing railway tracks are to be used, the conductors can be placed in the track surface without interference with the existing structure. If the track is a railway track, the conductors can be used as rails (see FIG. 5), where rails (conductors) 10 are snapped into track sections 14. The frequency of the alternating current can be variable or constant by using appropriate current/voltage/frequency regulators that are well known in themselves.

The rotary magnet element used in the present system may be in the form of a shaft or disc such as described in U.S. Pat. No. 4,459,438. That is, a shaft or disc that is rotatable about an axis of rotation, with the poles of the magnet comprising continguous halves of the shaft or disc disposed on opposite sides of the rotational axis. For example, the configuration of the magnet is clearly evident from viewing FIGS. 6 and 8. In this specific embodiment, the magnet is in the configuration of a cylinder of revolution with the opposite poles comprising contiguous halves of the cylinder on opposite sides of the central axis 48 of the magnet.

With reference to FIG. 6, a fixed or movable magnet 75 can be utilized adjacent the magnet rotor 30 to preposition the rotor to ensure that the magnet rotor 30 will be rotated in a specific direction when the alternating field 28 is generated. If desired, the magnet rotor 30 can also be pre-positioned by the momentary impression on conductor 10 of a direct current of appropriate polarity for the same purpose. Likewise, a combination of the fixed magnet 75 and the use of direct current in conductor 10 can be utilized to control the initial position and rotational direction of magnet rotor 30. Element 75 can also be a small piece of iron or permanent magnet that is appropriately fixed, movable, swingable, rotatable or translatable, with the distance between the element 75 and the permanent magnet 30 adjusted so that, when the alternating field 28 is established, the magnet 30 will at least initially resonate about its rotational axis at a frequency consistent with the interaction of forces between the field, the permanent magnet 30 and element 75. Such resonance will enable the starting of rotation of the permanent magnet 30 in a less harsh or abrupt manner, and with less current in conductor 10 (less field strength in field 28), since an initial oscillation period of the permanent magnet will occur before full rotation occurs. The element 75, moreover, can be arranged so as to be transportable or actuated into or out of its final position to enable it to be used, for example, as an "ignitor" starter device.

I claim:

1. An electromagnet drive system comprising:

a mobile object including a rotatable permanent magnet rotor having opposed pole sections arranged on opposite sides of the rotational axis of the rotor, said magnet arranged to motivate the object when rotated;

a non-coil configured electrical conductor in single wire form extending along a desired continuous path of motivation of the mobile object, said conductor arranged to be connected in a circuit to means for electrically energizing said conductor with alternating electrical current;

said permanent magnet rotor being disposed near the conductor so that a component of stray alternating field around the conductor extends generally perpendicular to the axis of rotor, whereby, upon energization of the conductor, the rotor will be synchronously rotated with the alternating field to motivate the mobile object.

2. An electromagnetic drive system as claimed in claim 1, wherein said conductor is supported by a track means for engaging and guiding the object, the track means having opposed lengthwise ends;

said conductor having opposed ends adjacent the ends of said track means;

electrical connector means at the opposed ends of the track means for connecting the opposed ends of the conductor to said circuit.

3. An electromagnet drive system as claimed in claim 1, wherein said conductor comprises a rail track means arranged to engage the mobile object motivated by the permanent magnet rotor.

4. An electromagnet drive system as claimed in claim 1, wherein said conductor is supported by an elongated track means, said track means and mobile object having cooperating surfaces for engaging each other.

5. An electromagnetic drive system comprising:

a mobile object including a rotatable permanent magnet rotor having opposed pole sections arranged on opposite sides of the rotational axis of the rotor, said magnet arranged to motivate the object when rotated;

a pair of non-coil configured conductors each in single wire form extending along a desired continuous path of motivation of the mobile object, said conductors arranged to be connected to circuit means for electrically energizing said conductors with alternating current;

said rotor disposed at least near one of the conductors so that at least a component of stray alternating current field around the conductor extends generallly perpendicular to the axis of the permanent magnet rotor when the conductor is energized with alternating current, whereby the rotor will be synchronously rotated with the alternating field in the vicinity of the at least one conductor when the at least one conductor is energized with alternating current, to thereby motivate the vehicle.

6. An electromagnetic drive system as claimed in claim 5, said conductors arranged to be energized with alternating current of identical direction of current, said mobile object being disposed between the conductors.

7. An electromagnetic drive system as claimed in claim 5, said conductors arranged to be energized with alternating current of opposite direction of current, said mobile object being disposed between the conductors.

8. An electromagnetic drive system as claimed in claim 5, 6 or 7, including a track means for engaging and guiding the object;

said conductors supported by said track means.

9. An electormagnetic drive system as claimed in claim 5, including:

a rail track means for engaging and guiding the object;

said rail track means comprising at least one of said conductors.

* * * * *